United States Patent [19]

Levenberg

[11] 4,329,967

[45] May 18, 1982

[54] ADJUSTABLE FLUE CONTROL FOR FURNACES

[76] Inventor: Nat Levenberg, 2 Windsor Pl., Lynbrook, N.Y. 11563

[21] Appl. No.: 191,009

[22] Filed: Sep. 26, 1980

[51] Int. Cl.[3] ..... F23L 3/00

[52] U.S. Cl. ..... 126/293; 126/295; 236/45

[58] Field of Search ..... 126/292, 285 R, 293, 126/289, 290, 312; 286/45

[56] References Cited

U.S. PATENT DOCUMENTS 2,264,590 12/1941 Sabins ..... 236/45

2,620,984 12/1952 Larsen ..... 236/45

2,990,118 6/1961 Steinen ..... 236/45

*Primary Examiner*—James C. Yeung

*Attorney, Agent, or Firm*—Charles E. Temko

[57] ABSTRACT

A damper type control for furnace flues which opens with commencement of oil burner operation and closes when combustion ceases. The damper is operated solely by the presence of draft created by the oil burner blower, and closes in the absence of such draft under the influence of a counterweight. With the occurrence of wind passing the open end of the flue, the pressure differential on either side of the damper also assists in maintaining the damper in closed condition.

2 Claims, 4 Drawing Figures

ADJUSTABLE FLUE CONTROL FOR FURNACES

BACKGROUND OF THE INVENTION

This invention relates generally to the field of flue dampers for conducting the products of combustion in a furnace to the outside atmosphere. More particularly it relates to an improved construction of this type of relatively simple design permitting corresponding low cost of manufacture, and with high reliability in operation. Devices of this general type are well known in the art, and the invention lies in specific constructional details which permit these advantages.

In those installations having a gun type oil burner, it is common practice to provide a side vent which employs a counterbalanced butterfly valve to establish periodic communication between the lower end of the flue and the furnace room. When this valve is opened, air flows from the furnace room to the flue to maintain draft emanating from the oil burner at a relatively constant level during burner operation. However, when the burner is not in operation, a substantial wind passing the open end of the flue will also draw warm air from the furnace plenum and thereby waste fuel necessary to reheat the plenum when the burner commences a subsequent cycle of operation.

With the rapid increase in the cost of petroleum fuels, attempts have been made to provide flue damper which will positively close the flue above the side vent to stop the flow of warm air up the flue when the burner cycle has ended. A common type includes a butterfly type valve operated by a motor or an electrical solenoid energized simultaneously with the oil burner motor. While effective, this construction is quite costly, and requires the efforts of both an electrician and a plumber to install.

Somewhat simpler structures are described in the United States patent to Sabins, U.S. Pat. No. 2,264,590 granted Dec. 2, 1941, and a series of patents granted to Steinen, namely U.S. Pat. Nos. 2,904,255 of Sept. 15, 1951; 2,990,118 granted June 27, 1961; 3,070,312 granted Dec. 25, 1962; and 3,077,305 granted Feb. 12, 1963. Each of the above patents teaches an in-line damper of butterfly valve type having adjustable weights on either side thereof to provide a high degree of sensitivity to the existence of a pressure differential on either side of the valve. The present invention is directed to a valve construction of this general type.

In my above mentioned co-pending application, there are disclosed a plurality of weight elements mounted upon and pivoting with a valve member, one of said weights being adjustable from outside the flue pipe in which the device is installed. While convenient and effective, the structure is not without complexity tending to add to the cost of fabrication.

SUMMARY OF THE INVENTION

Briefly stated, the present invention lies in the provision of an improved counterbalanced butterfly valve of the type disclosed in my above identified application. Two of the three weights are threadedly mounted upon a common shaft extending through the plane of the butterfly valve near the axis of pivotal mounting. The weights are disposed on opposite sides of that plane and once independently adjusted, are movable in unison by rotating the shaft, one end of which is accessible through a small opening in the flue pipe in which it is installed, without the necessity of disassembling that portion of the flue.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
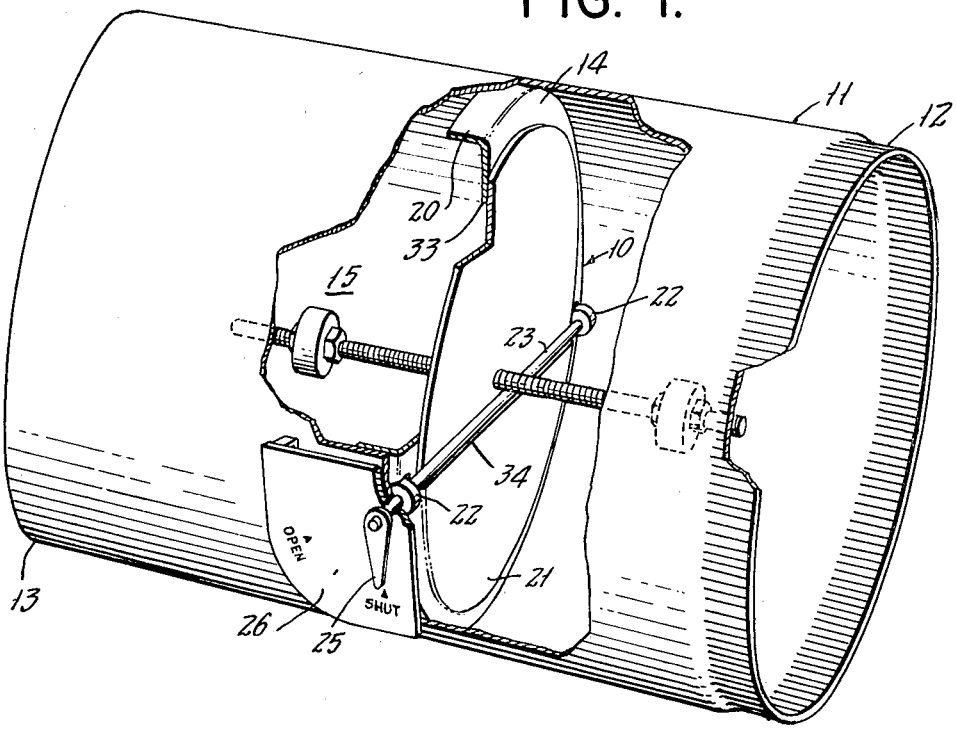
FIG. 1 is a view in perspective, partly broken away to show detail of an embodiment of the invention.

In accordance with the invention, the device, generally indicated by reference character 10, includes a length of flue pipe 11, having a first end 12 which forms a part of a flue (not shown) leading to a furnace, and a second end 13 forming a part of the flue leading to the outside atmosphere. Disposed within the pipe 11 is a valve body (FIGS. 1 and 2) secured to the inner surface 15 thereof by welding or other suitable means. The valve body 14 includes a fixed element 16 and a movable element 17.

The element 16 includes a cylindrical sleeve 20 mounting an orificed transversely extending planar member 21, and a pair of bearing members 22 which support a transversely extending shaft 23 upon which the movable element 17 is mounted. One end 24 of the shaft 23 extends through an opening in the pipe 11 and mounts an indicator 25 which cooperates with an indicia plate 26 to indicate to a viewer whether the movable element 17 is opened or closed relative to the fixed element 16.

The planar member 21 is bounded by first and second surfaces 30 and 31, respectively, surrounding a through opening 32 extending therebetween, the opening being bounded by a curved edge 33 and a rectilinear edge 34.

The movable element 17 includes a generally circular plate 40 formed by a relatively larger portion 41 and a relatively smaller portion 42 between which the shaft 23 extends. Mounted upon the plate 40 are first, second and third weight elements 44, 45 and 46, respectively.

Figure 2:
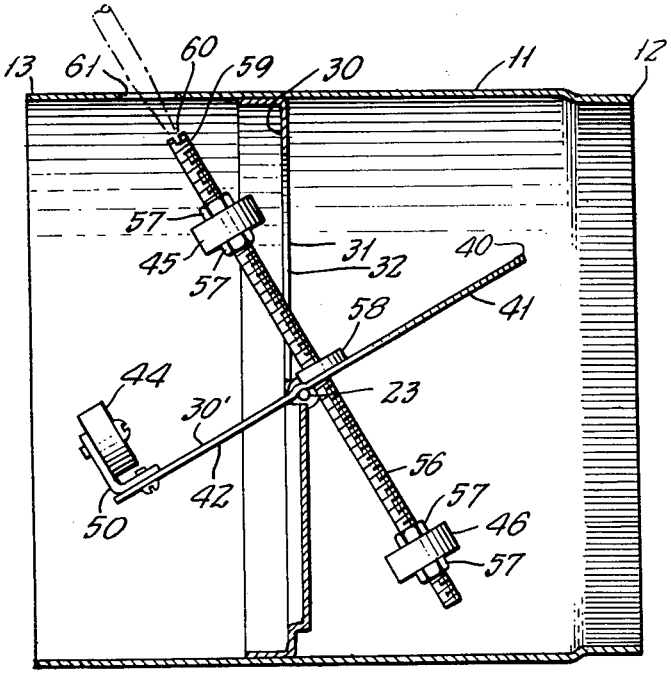
FIG. 2 is a vertical longitudinal central sectional view thereof.
Figure 3:
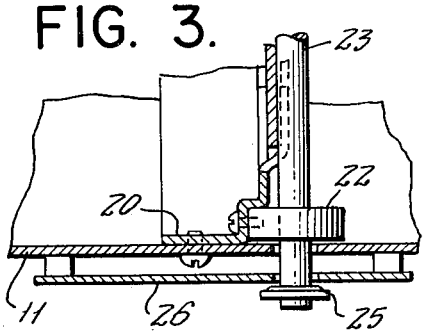
FIG. 3 is an enlarged fragmentary horizontal sectional view thereof as seen from the plane 3—3 in FIG. 1.
Figure 4:
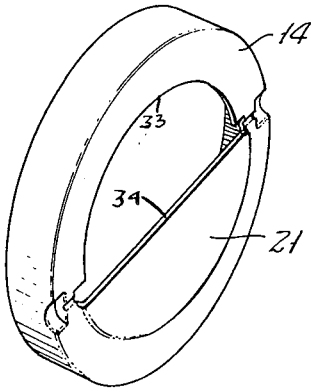
FIG. 4 is a view in perspective of a fixed element forming parts of a valve body embodying the invention.

The first weight element 44 includes a mounting bracket 50 secured to the surface 30 of generally L-shaped configuration. After installation, it is non-adjustable. The second and third weight elements are each threadedly mounted on a shaft 56 and fixed by locking nuts 57. The shaft 56 engages a threaded member 58 on the plate 40. One end 59 of the shaft 56 is provided with tool engaging means in the form of a screwdriver slot 60, and is selectively alignable with an opening 61 in the flue pipe 11 when the plate 40 is in opened condition. This can be manually accomplished without disassembling the flue pipe by merely moving the indicator 25 leftwardly as seen in FIG. 1 until the alignment shown in FIG. 2 is obtained.

As the shaft 56 is rotated, both the second and third weights will be shifted simultaneously, thereby permitting a very substantial change in balance with relatively little rotation of the shaft.

I wish it to be understood that I do not consider the invention limited to the precise details of structure shown and set forth in this specification, for obvious modifications will occur to those skilled in the art to which the invention pertains.

I claim:

1. In a furnace flue damper construction including a length of flue pipe directly connected in series with the smoke pipe emanating from a furnace, an orificed plate positioned transversely with respect to the principal axis of said pipe therein, and a butterfly type valve member having a shaft pivotally mounted with respect to said orificed plate to selectively close an orifice therein, the improvement comprising: first, second and third weight elements; said first weight element being mounted upon a first side of said valve member; a threaded shaft extending through said valve member and threadedly engaged therewith, said second and third weight elements being threadedly engaged upon said shaft adjacent oppositely disposed ends thereof, one of said ends having tool engaging means thereon; said flue pipe having a transversely extending opening therein of diameter corresponding to that of said shaft, serving to expose said free end thereof when said valve member is in predetermined position, and means for manually placing said valve member in said predetermined position.

2. The improvements set forth in claim 1, further comprising indicator means positioned externally of said flue pipe and connected to said pivotally mounted shaft for showing the position of said valve member, said indicator means being manually engageable to move said valve member to said predetermined position.

* * * * *